US006132810A

United States Patent [19]

Swain et al.

[11] Patent Number: 6,132,810

[45] Date of Patent: Oct. 17, 2000

[54] COATING METHOD

[75] Inventors: Eugene A. Swain, Webster; John S. Chambers, Rochester; Huoy-Jen Yuh, Pittsford; Geoffrey M. T. Foley, Fairport, all of N.Y.

[73] Assignee: Xerox Corporation, Stamford, Conn.

[21] Appl. No.: 09/079,086

[22] Filed: May 14, 1998

[51] Int. Cl.[7] ..... B05D 1/18; B05D 1/36

[52] U.S. Cl. ..... 427/430.1; 427/230; 427/402; 427/407.1; 430/58; 430/131; 430/133

[58] Field of Search ..... 427/230, 402, 427/407.1, 430.1, 443.2; 430/58, 64, 66, 131, 133, 134

[56] References Cited

U.S. PATENT DOCUMENTS

| | | | |
|---|---|---|---|
| 3,890,183 | 6/1975 | Farnam | 156/193 |
| 4,588,667 | 5/1986 | Jones et al. | 430/73 |
| 4,610,942 | 9/1986 | Yashiki et al. | 430/58 |
| 4,680,246 | 7/1987 | Aoki et al. | 430/133 |
| 5,112,656 | 5/1992 | Nakamura et al. | 427/425 |
| 5,320,364 | 6/1994 | Mistrater et al. | 279/2.17 |
| 5,520,399 | 5/1996 | Swain et al. | 279/2.15 |
| 5,578,410 | 11/1996 | Petropoulos et al. | 430/133 |
| 5,633,046 | 5/1997 | Petropoulos et al. | 427/430.1 |
| 5,667,928 | 9/1997 | Thomas et al. | 430/134 |
| 5,681,392 | 10/1997 | Swain | 118/407 |
| 5,688,327 | 11/1997 | Swain et al. | 118/500 |

*Primary Examiner*—Timothy Meeks
*Assistant Examiner*—Michael Barr
*Attorney, Agent, or Firm*—Zosan S. Soong

[57] ABSTRACT

A coating method using an endless, hollow substrate in the shape of a belt or cylinder having an outer surface, an inner surface, a first end, and an open second end, including: (a) depositing via dip coating a first coating solution over the outer surface of the substrate and simultaneously over the inner surface by permitting the first coating solution to flow through the second end to be deposited on the inner surface, thereby depositing a first layer over the outer surface and the inner surface; and (b) depositing via dip coating a second coating solution over the first layer on the outer surface of the substrate and simultaneously over the first layer on the inner surface by permitting the second coating solution to flow through the second end to be deposited on the first layer on the inner surface, thereby depositing a second layer over the outer surface and the inner surface, wherein the first layer and the second layer are deposited over all of the outer surface and the inner surface of a predetermined section of the substrate, wherein the first coating solution and the second coating solution are selected from the group consisting of a charge generating solution, a charge transport solution, an adhesive layer solution, and a charge blocking layer.

5 Claims, No Drawings

COATING METHOD

FIELD OF THE INVENTION

This invention relates to a dip coating method useful for fabricating photoreceptors.

BACKGROUND OF THE INVENTION

Photoreceptors used in electrostatographic printing machines are typically fabricated by a dip coating method where the substrate is engaged with a chuck apparatus at the top of the substrate and the chuck apparatus forms a hermetic seal with the inner surface of the substrate which traps air inside the substrate when it is dipped into the coating solution. The trapped air provided by the hermetic seal prevents the coating solution from coating the substrate's inner surface. The conventional dip coating method coats only the outer surface of the substrate (even with a hermetic seal, a small portion of the inner surface adjacent an end of the substrate may be coated by the coating solution) during the fabrication of the photoreceptor. The problem with creating a hermetic seal is that the trapped air may vibrate like a spring due to its compressibility during the dip coating, potentially causing coating nonuniformities in the thickness of the coated layer—the chatter line defect. The present inventors have found that the tendency for the trapped air to vibrate during dip coating increases with larger substrates, thinner substrate walls, and lower viscosity coating solutions. Complicated chuck designs or thick walled substrates can be used to overcome the vibration problem, which undesirably increase costs or limit the type of substrates that can be used. In addition, the trapped air can also leak out and cause a coating defect, called burping. There is a need, which the present invention addresses, for new dip coating methods which minimize or avoid the problems described above.

Conventional methods for fabricating photoreceptors, including descriptions of suitable chuck apparatus, are described in Swain, U.S. Pat. No. 5,681,392; Petropoulos et al., U.S. Pat. No. 5,633,046; Petropoulos et al., U.S. Pat. No. 5,578,410; Swain et al., U.S. Pat. No. 5,520,399 and Swain et al., U.S. Pat. No. 5,688,327.

SUMMARY OF THE INVENTION

The present invention is accomplished in embodiments by providing a coating method using an endless, hollow substrate in the shape of a belt or cylinder having an outer surface, an inner surface, a first end, and an open second end, comprising:

(a) depositing via dip coating a first coating solution over the outer surface of the substrate and simultaneously over the inner surface by permitting the first coating solution to flow through the second end to be deposited on the inner surface, thereby depositing a first layer over the outer surface and the inner surface; and (b) depositing via dip coating a second coating solution over the first layer on the outer surface of the substrate and simultaneously over the first layer on the inner surface by permitting the second coating solution to flow through the second end to be deposited on the first layer on the inner surface, thereby depositing a second layer over the outer surface and the inner surface, wherein the first layer and the second layer are deposited over all of the outer surface and the inner surface of a predetermined section of the substrate, wherein the first coating solution and the second coating solution are selected from the group consisting of a charge generating solution, a charge transport solution, an adhesive layer solution, and a charge blocking layer.

In embodiments of the present invention, there is further comprising: (c) depositing via dip coating a third coating solution over the second layer on the outer surface of the substrate and simultaneously over the second layer on the inner surface by permitting the third coating solution to flow through the second end to be deposited on the second layer on the inner surface, thereby depositing a third layer over the outer surface and the inner surface, wherein the first layer, the second layer, and the third layer are deposited over all of the outer surface and the inner surface of the predetermined section of the substrate, wherein the third coating solution is selected from the group consisting of the charge generating solution, the charge transport solution, the adhesive layer solution, and the charge blocking solution.

In other embodiments, there is provided a coating method using an endless, hollow substrate in the shape of a belt or cylinder having an outer surface, an inner surface, a first end, and an open second end, comprising:

(a) depositing via dip coating a lower viscosity coating solution over the outer surface of the substrate and simultaneously over the inner surface by permitting the lower viscosity coating solution to flow through the second end to he deposited on the inner surface, thereby depositing a first layer over the outer surface and the inner surface; and (b) depositing via dip coating a higher viscosity coating solution over the first layer on the outer surface of the substrate and preventing the higher viscosity coating solution at the second end from rising within the hollow portion of the substrate by creating a hermetic seal within the substrate to trap an air pocket in the substrate above the higher viscosity solution at the second end.

DETAILED DESCRIPTION

The phrase "dip coating" encompasses the following techniques to deposit layered material onto a substrate: moving the substrate into and out of the coating solution; raising and lowering the coating vessel to contact the solution with the substrate; and while the substrate is positioned in the coating vessel filling the vessel with the solution and then draining the solution from the vessel. The substrate may be moved into and out of the solution at any suitable speed including the takeup speed indicated in Yashiki et al., U.S. Pat. No. 4,610,942, the disclosure of which is hereby totally incorporated by reference. The dipping speed may range for example from about 50 to about 1500 mm/min and may be a constant or changing value. The takeup speed during the raising of the substrate may range for example from about 50 to about 500 mm/min and may be a constant or changing value. In one embodiment, the takeup speed is the same or different constant value for all the dip coating steps of the present invention. Preferably, all the substrates in a batch are dip coated substantially simultaneously, preferably simultaneously, in each coating solution. A preferred equipment to control the speed of the substrate during dip coating is available from Allen-Bradley Corporation and involves a programmable logic controller with an intelligent motion controller. With the exception of the wet coating solution bead which is at the bottom edge of the substrate, the thickness of each wet coated layer on the substrate may be relatively uniform and may be for example from about 1 to about 60 micrometers in thickness. Each coated layer when dried may have a thickness ranging for example from about 0.001 to about 60 micrometers.

The substrate preferably has a hollow, endless configuration and defines a top region (a non-imaging area), a center region (an imaging area), and an end region (a non-imaging area). The precise dimensions of these three substrate regions vary in embodiments. As illustrative dimensions, the top region ranges in length from about 10 to about 50 mm, and preferably from about 20 to about 40 mm. The center region may range in length from about 200 to about 400 mm, and preferably from about 250 to about 300 mm. The end region may range in length from about 10 to about 50 mm, and preferably from about 20 to about 40 mm. The substrate may have an outside diameter of at least 170 mm, preferably an outside diameter ranging for example from about 170 mm to about 400 mm, and a wall thickness ranging for example from about 0.01 to about 30 mm.

Any suitable chuck apparatus can be used to hold the substrates including for example the chuck apparatus disclosed in Swain et al., U.S. Pat. No. 5,520,399 and Swain et al., U.S. Pat. No. 5,688,327, the disclosures of which are hereby totally incorporated by reference. It is noted that the chuck apparatus depicted in these two patents are primarily directed to those coating steps requiring a hermetic seal between the chuck apparatus and the inner surface of the substrate. To use the chuck apparatus depicted in the '399 patent without a hermetic seal, it is apparent that one could remove the detachable elastic membrane 4 so that the radially movable members 6 directly contact the substrate inner surface. Alternatively, to use the same chucking apparatus for a method encompassing both a coating step involving a hermetic seal and a coating step conducted in the absence of a hermetic seal, one can use the chuck apparatus depicted in the '327 patent where the solenoid valve 62 of the gas pressure regulating apparatus 50 can be opened or closed depending upon whether migration of the coating solution up into the substrate interior is desired. A chucking apparatus engages the top end of the substrate and lowers the end region, the center region, and optionally a part of the top region into the coating solution.

Between dip coating steps, a part of the solvent from the wet coated layer may be removed by exposure to ambient air (i.e., evaporation process) for a period of time ranging for example from about 1 to about 20 minutes, preferably from about 5 to about 10 minutes. Thus, in embodiments, the present method removes a portion of the wetness from an earlier deposited layer prior to depositing another layer on top of the earlier deposited layer. The coated layer is sufficiently dry with no fear of contamination of the next coating solution when gentle rubbing with a finger or cloth fails to remove any of the coated layer.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness from about 50 Angstroms to about 30 micrometers, although the thickness can be outside of this range. When a flexible electrophotographic imaging member is desired, the substrate thickness typically is from about 0.015 mm to about 0.15 mm. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX® 447 (available from ICI Americas, Inc.), and the like. If desired, a conductive substrate can be coated onto an insulating material. In addition, the substrate can comprise a metallized plastic, such as titanized or aluminized MYLAR®. The coated or uncoated substrate can be flexible or rigid, and can have any number of configurations such as a cylindrical drum, an endless flexible belt, and the like.

Each coating solution may comprise materials typically used for any layer of a photosensitive member including such layers as a charge barrier layer, an adhesive layer, a charge transport layer, and a charge generating layer, such materials and amounts thereof being illustrated for instance in U.S. Pat. No. 4,265,990, U.S. Pat. No. 4,390,611, U.S. Pat. No. 4,551,404, U.S. Pat. No. 4,588,667, U.S. Pat. No. 4,596,754, and U.S. Pat. No. 4,797,337, the disclosures of which are totally incorporated by reference.

In embodiments, a coating solution may include the materials for a charge barrier layer including for example polymers such as polyvinylbutyral, epoxy resins, polyesters, polysiloxanes, polyamides, or polyurethanes. Materials for the charge barrier layer are disclosed in U.S. Pat. Nos. 5,244,762 and 4,988,597, the disclosures of which are totally incorporated by reference.

The optional adhesive layer preferably has a dry thickness between about 0.001 micrometer to about 0.2 micrometer. A typical adhesive layer includes film-forming polymers such as polyester, du Pont 49,000 resin (available from E. I. du Pont de Nemours & Co.). VITEIL-PE100® (available from Goodyear Rubber & Tire Co.), polyvinylbutyral, polyvinylpyrrolidone, polyurethane, polymethyl methacrylate, and the like. In embodiments, the same material can function as an adhesive layer and as a charge blocking layer.

In embodiments, a charge generating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochlorophthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. A representative charge generating solution comprises: 2% by weight hydroxy gallium phthalocyanine; 1% by weight terpolymer of vinyl acetate, vinyl chloride, and maleic acid; and 97% by weight cyclohexanone.

In embodiments, a charge transport solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like. An illustrative charge transport solution has the following composition: 10% by weight N,N'-diphenyl-N,N'-bis(3-methylphenyl)-(1,1'-biphenyl)-4,4'diamine; 14% by weight poly(4,4'-diphenyl-1,1'-cyclohexane carbonate) (400 molecular weight); 57% by weight tetrahydrofuran; and 19% by weight monochlorobenzene.

A coating solution may also contain a solvent, preferably an organic solvent, such as one or more of the following: tetrahydrofuran, monochlorobenzene, and cyclohexanone.

After all the desired layers are coated onto the substrates, they may be subjected to elevated drying temperatures such as from about 100 to about 160° C. for about 0.2 to about 2 hours.

In one embodiment of the present method, a layer of the charge generating solution is applied prior to deposition of a layer of the charge transport solution. Where an optional undercoat layer (e.g., an adhesive layer or a charge blocking layer) is desired, the undercoat layer is applied first to the substrate, prior to the deposition of any other layer.

The lower and higher viscosity coating soutions are now discussed. The lower viscosity coating solution has a viscosity ranging for example from about 1 to about 6 centipoise, preferably from about 3.5 to about 4.5 centipoise, and may be a charge generating solution, an adhesive layer solution, and a charge blocking solution. The higher viscosity coating solution has a viscosity ranging for example from about 7 to about 500 centipoise, preferably from about 7 to about 400 centipoise, and more preferably from about 10 to about 300 centipoise, and may be a charge transport solution.

The present invention offers a number of advantages: simplifies the chuck apparatus required for dip coating; and enables in certain embodiments a relatively uniform (in thickness) coating of lower viscosity solutions including some charge generating solutions and some undercoat layer solutions.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLE

A seamless nickel belt (175 mm diameter×350 mm long) having a thickness of about 2 mils was dip coated with a charge generating solution composed of benzimidazole perylene and polyvinyl butyral (68/32 weight ratio) in n-butyl acetate solvent. The charge generating solution was newtonian and very stable (no flocculation or separation occurred) and had 5% by weight solids and a viscosity of about 4 centipoise. The belt was chucked on the top, without creating a hermetic seal between the chuck apparatus and the inner surface of the belt, and dipped into the charge generating solution. The belt was pulled out at a constant rate of about 200 mm/min to deposit a layer of the charge generating solution on all of the outer surface and the inner surface of the belt except for the top region of the belt which is a non-imaging area. The coated layer was dried to a thickness of about 0.6 micrometer. The charge generating layer on the belt's outer surface exhibited satisfactory thickness uniformity in the center region which is the imaging area.

COMPARATIVE EXAMPLE

A belt was dip coated using the same materials and conditions as described in the Example except a hermetic seal was created between the chuck apparatus and the inner surface of the belt to prevent the charge generating solution from coating most of the belt's inner surface. When the chuck apparatus was sealed to the belt, air was trapped inside the belt when it was dipped into the charge generating solution. A large volume of the solution was displaced in order to accommodate the air inside the belt when the belt was fully immersed in the solution. When the belt was pulled out of the charge generating solution, this volume of solution was replaced by additional charge generating solution from a holding tank. The trapped air inside the belt compressed and vibrated during the immersion and pullup stages. The vibrations caused the charge generating layer on the center region (the imaging area) to undesirably exhibit a thickness nonuniformity—a chatter line defect.

Other modifications of the present invention may occur to those skilled in the art based upon a reading of the present disclosure and these modifications are intended to be included within the scope of the present invention.

We claim:

1. A coating method using an endless, hollow substrate in the shape of a belt or cylinder having an outer surface, an inner surface, a first end, and an open second end, comprising:

(a) depositing via dip coating a first coating solution over the outer surface of the substrate and simultaneously over the inner surface by permitting the first coating solution to flow through the second end to be deposited on the inner surface; and (b) depositing via dip coating a second coating solution on the outer surface of the substrate and preventing the second coating solution at the second end from rising within the hollow portion of the substrate by creating a hermetic seal within the substrate to trap an air pocket in the substrate above the second solution at the second end, wherein the first coating solution has a lower viscosity than the second coating solution.

2. The method of claim 1, wherein the first coating solution is selected from the group consisting of a charge generating solution, an adhesive layer solution, and a charge blocking solution.

3. The method of claim 1, wherein the second coating solution is a charge transport solution.

4. The method of claim 1, wherein the first coating solution has a viscosity ranging from about 1 to about 6 centipoise.

5. The method of claim 1, wherein the second coating solution has a viscosity ranging from about 7 to about 500 centipoise.

* * * * *